US011656048B1

(12) United States Patent
Goldstein

(10) Patent No.: US 11,656,048 B1
(45) Date of Patent: May 23, 2023

(54) SMART AMMUNITION WITH E-PRIMER TECHNOLOGY TO ENHANCE PUBLIC SAFETY BY ELECTRONICALLY PREVENTING THE DISCHARGING OF A FIREARM

(71) Applicant: Zachary Matthew Goldstein, Delray Beach, FL (US)

(72) Inventor: Zachary Matthew Goldstein, Delray Beach, FL (US)

( * ) Notice: Subject to any disclaimer, the term of this patent is extended or adjusted under 35 U.S.C. 154(b) by 0 days.

(21) Appl. No.: 17/086,058

(22) Filed: Oct. 30, 2020

Related U.S. Application Data

(60) Provisional application No. 62/928,235, filed on Oct. 30, 2019.

(51) Int. Cl.

| | |
|---|---|
| ***F42B 5/08*** | (2006.01) |
| ***F42C 15/40*** | (2006.01) |
| ***F42C 15/42*** | (2006.01) |
| ***F41A 17/06*** | (2006.01) |
| ***F42C 19/12*** | (2006.01) |
| ***F41A 19/62*** | (2006.01) |
| *F42C 14/00* | (2006.01) |

(52) U.S. Cl.
CPC ..... *F41A 19/62* (2013.01); *F41A 17/06* (2013.01); *F41A 17/063* (2013.01); *F42B 5/08* (2013.01); *F42C 15/40* (2013.01); *F42C 15/42* (2013.01); *F42C 19/12* (2013.01); *F42C 14/00* (2013.01)

(58) Field of Classification Search
CPC ..... F42C 15/00; F42C 15/40; F42C 15/42; F42C 15/44; F42C 19/12; F41A 17/06; F41A 17/063; F41A 19/58; F41A 19/60; F41A 19/62; F42B 5/08
USPC ..... 102/202, 202.1, 202.2, 210; 42/49.01
See application file for complete search history.

(56) References Cited

U.S. PATENT DOCUMENTS

| | | | | |
|---|---|---|---|---|
| 3,859,746 | A * | 1/1975 | Pecksen | F41A 19/62 102/210 |
| 6,283,034 | B1 * | 9/2001 | Miles, Jr. | F42B 5/08 42/70.11 |
| 11,215,432 | B2 * | 1/2022 | Nath | F42C 15/42 |
| 2006/0117632 | A1 * | 6/2006 | Meyerle | F41A 19/58 42/70.01 |

(Continued)

*Primary Examiner* — James S Bergin
(74) *Attorney, Agent, or Firm* — Howard M. Gitten, Esq.; Lewis Brisbois Bisgaard & Smith LLP

(57) ABSTRACT

An energy harvesting electronic primer (e-primer) system including smart ammunition with e-primer technology to enhance public safety from the discharge of a firearm by replacing conventional mechanical primers used for the activation of energetic materials with an electronic primer in center fire type ammunitions, grenades, bombs and other explosive devices wherein the ammunition includes an e-primer system having a firing pin, primer cup with a safety switch, antenna, piezo element, diode, capacitor, microcontroller, thermal wire, nanoenergetic and flash hole and radio transmitter circuitry wherein the mechanical force of the firing pin strikes a nanoenergetic material to activate the initial phase of an energetic train unless the e-primer is neutralized by a radio or acoustic signal captured by the antenna mounted within the ammunition where the radio signal includes a deactivation code to neutralize the ammunition. when located in a space specifically designed to receive the radio or acoustic signal.

17 Claims, 2 Drawing Sheets

(56) References Cited

U.S. PATENT DOCUMENTS

| | | | | |
|---|---|---|---|---|
| 2014/0083318 | A1* | 3/2014 | Tempi | F41A 19/62<br>102/215 |
| 2019/0154381 | A1* | 5/2019 | Goldstein | F41A 17/063 |
| 2019/0293397 | A1* | 9/2019 | Du | F42C 15/40 |
| 2022/0373285 | A1* | 11/2022 | Goldstein | F42B 12/46 |

* cited by examiner

SMART AMMUNITION WITH E-PRIMER TECHNOLOGY TO ENHANCE PUBLIC SAFETY BY ELECTRONICALLY PREVENTING THE DISCHARGING OF A FIREARM

CROSS-REFERENCE TO RELATED APPLICATION

This application claims the benefit of provisional patent application Ser. No. 61/280,237 filed Oct. 30, 2020.

STATEMENT REGARDING FEDERALLY SPONSORED RESEARCH OR DEVELOPMENT

N/A

FIELD OF THE INVENTION

The present invention relates to ammunition, and in particular, to smart ammunition withe-primer technology to enhance public safety for the discharge of a firearm by replacing conventional mechanical primers used for the activation of energetic materials with an electronic primer (e-primer).

BACKGROUND OF THE INVENTION

Technology may provide the answers in the quest to resolve one of our nation's most controversial societal issues: gun violence and the harm caused by the widespread use of guns. In the past decade, over one million Americans have been shot, and approximately 31,000 people are killed each year by firearms. That rate is nearly 20 times greater than other industrialized countries. In order to reduce the harm caused by the widespread use of guns, various technological solutions have been proposed. Moreover, easy access to firearms enables the unintended discharge by youths and others who aren't trained in weapon safety causing thousands of accidental shootings every year.

Each year in the U.S. alone approximately 900 teenagers take their own life with a firearm and cause thousands of unintended shootings. The Center for Disease control reports indicate at 84% of those suicides makes use of the parents' gun or someone they know. Finally, the epidemic shootings taking place at our nation's schools have now reached over 600 children that have been shot or killed since the Sandy Hook tragedies. Of these shootings, over 67% used their parents' gun. It has become clear that access to a weapon by an unauthorized user is the critical element of the calculus in order to mitigate these tragedies and improve safety. The instant invention addresses this unfulfilled need in the prior art by providing smart ammunition with electronic primer technology to enhance public safety by electronically preventing the discharging of a firearm.

SUMMARY OF THE INVENTION

In light of the foregoing, it is an object of the present invention to provide smart ammunition with e-primer technology to enhance public safety from the discharge of a firearm by replacing conventional mechanical primers (shock sensitive chemical) used for the activation of energetic materials with an electronic primer (referenced herein as an e-primer) in center fire type ammunitions, grenades, bombs and other explosive devices.

In accordance with one aspect, the present invention provides an e-primer system including an antenna, a piezo crystal, a diode, a capacitor, a microcontroller with RF receiver, a thermal wire, a nanoenergetic material and a switch which can be implemented either mechanically or electronically and that can be mounted within the primer cup or operatively coupled to the nanoenergetic material.

In another aspect, the present invention provides smart ammunition with e-primer technology that includes a firing pin and primer cup with a safety switch, antenna, piezo element, diode, capacitor, microcontroller with RF receiver, thermal wire, nanoenergetic and flash hole, wherein the mechanical force of the firing pin strikes an nanoenergetic material and activates the initial phase of an energetic train.

In an additional aspect, the present invention provides an e-primer system including an antenna, a piezo crystal, a diode, a capacitor, a microcontroller, a thermal wire, a nanoenergetic material and a switch in a primer cup casing and radio receiver technology wherein the e-primer can be neutralized when located in a space specifically designed to receive a radio signal from the remote sender station which would be captured by the antenna mounted within the ammunition wherein the radio signal can send a deactivation code to neutralize the primer cap to fire the ammunition.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
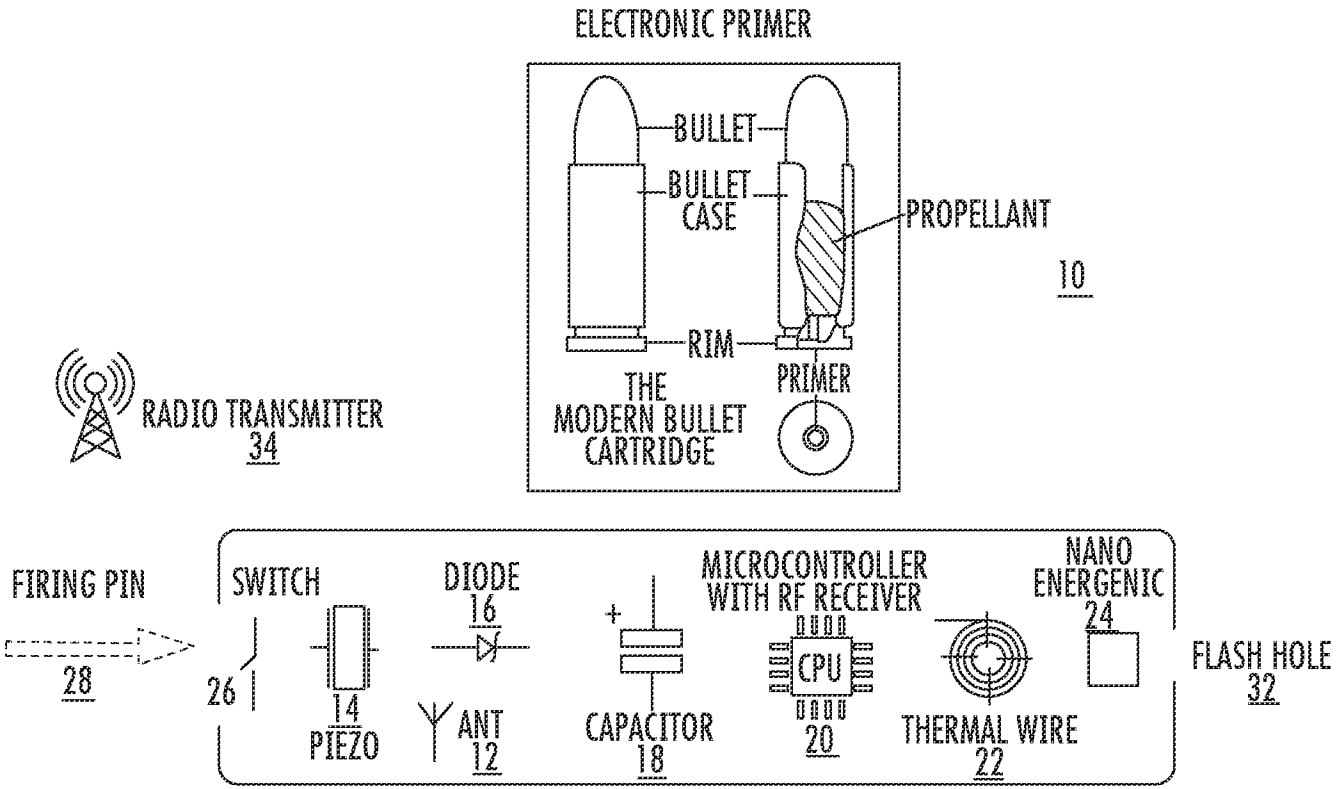
FIG. 1 is front perspective view and electronic diagram of the smart ammunition with electronic primer technology in accordance with the principles of the present invention.
Figure 2:
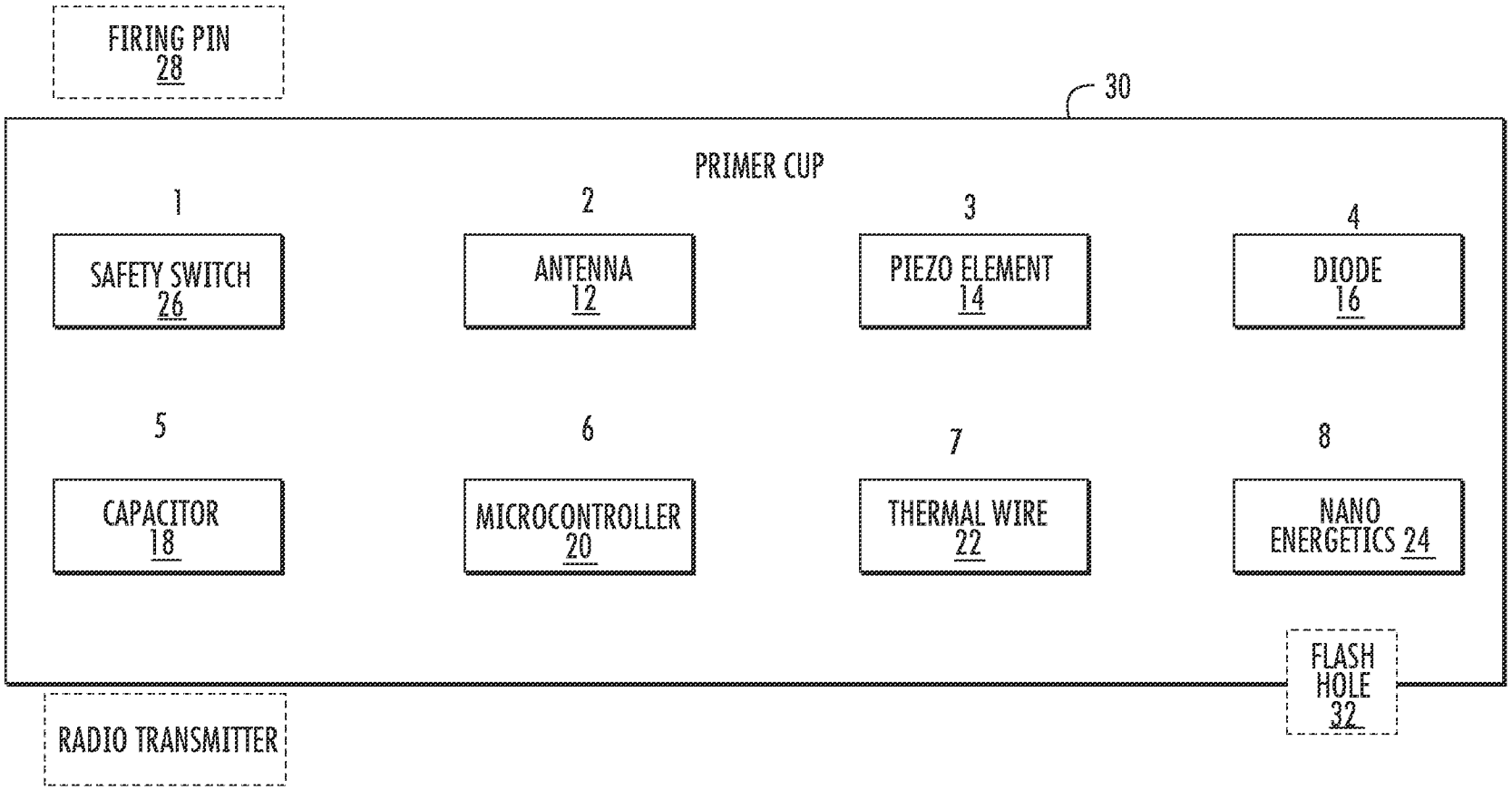
FIG. 2 is a block diagram of the smart ammunition with electronic primer technology shown in FIG. 1.

With reference to the drawings in which like reference designators refer to like elements, FIGS. 1-2 depict the preferred and alternative embodiments of the instant invention which is generally referenced as an e-primer, e-primer system and, or by numeric character 10. The instant invention 10 teaches smart ammunition with e-primer technology to enhance public safety for the discharge of a firearm. This invention 10 disclosed below teaches the design, operation and benefits of an energy harvesting electronic primer system that can be remotely neutralized or activated using RF or acoustic transmission. This new primer 10 replaces conventional mechanical (shock sensitive chemical) primers 1, shown in FIG. 1 used for the activation of energetic materials with a batteryless electronic primer, which is referred to as an e-primer. One application of thee-primer 10 would be used to replace conventional or mechanical primer (shock sensitive chemical) used in center fire type ammunitions. Other applications include primers used in grenades, bombs and explosive devices where the activation of an energetic material is used to produce a desired outcome and whereby the energetic material requires an activation mechanism normally enabled by some form of a conventional primer system that uses a mechanical force (shock sensitive chemical) of a firing pin or other structure to strike a nanoenergetic material and activate the initial phase of an energetic train. Furthermore, applications of minefields or other explosives that can be remotely neutralized or activated are made possible.

Thee-primer system 10 consists of an antenna or RF receiver 12, a piezo crystal 14, a diode 16, a capacitor 18, a microcontroller with RF receiver 20, a thermal wire 22, a nanoenergetic material 24 and a switch 26 which can be implemented either mechanically or electronically. These technologies can be mounted within the primer cup 30 or operatively coupled to the nanoenergetic material 24. The e-primer system 10 may also include a radio or RF or sound wave transmitter or carrier 34 and, or firing pin or percussive stimulus 28.

The e-primer 10 offers many advantages over mechanically (shock sensitive chemical) activated primers. To begin, there are a number of applications where the control of the explosives can be neutralized from a remote location or sender station 34 such that even in the event of the mechanical firing pin 28 being activated by the necessary force, an energetic train would be prevented from taking place. In another embodiment, the energetic train could be initiated from remote control using a radio frequency carrier 34 to supply power and control signals for the microcontroller or by providing power and control signals to the microcontroller 20 by acoustic means by vibrating the piezo. In either case, the deformation of piezo element 14 would be required to provide the power to activate the thermal element. Yet in another embodiment as in the case of a round of ammunition with a center fire primer mechanism typically found in semi-automatic hand guns, revolvers, long-rifles, but not normally used in shotguns, the ammunition equipped with an e-primer 10 can be neutralized or activated assuming the ammunition was located in a space specifically designed to receive a radio signal or acoustic signal which would be captured by an antenna/piezo resonator 12 mounted within the ammunition. The radio signal or acoustic signal can send a deactivation code from the remote sender station, which in turn would be acquired up by the e-primer 10 and decoded by the microprocessor 20 mounted within the primer cup 30. The microprocessor 20 electronically prevents the ignition process within the e-primer 10 thus preventing the discharge of the ammunition within the firearm while in the particular space. When a firearms' trigger is pulled, the firing rod and pin 28 engages with a primer cup 30 mounted in the ammunition casing, the process known as Firing. Firing is the sequence of events which ignites the nanoenergetic material 24 in the primer cup 30 which in turn ignites the propellant charge in the cartridge. The primer cup 30 contains a small amount of percussion-sensitive explosive. Within the primer cup 30, when a striker 28 hits the primer with sufficient mechanical shock it detonates the primer material. This sends hot burning particles of primer nanoenergetic material 24 through the flash hole 32 into contact with the propellant, beginning its burning. In single-shot and semiautomatic operation, each activation of the trigger permits only one shot. In fully-automatic operation the entire operating cycle repeats while the trigger is pressed, and ammunition is fed.

The flash in turn is used as the catalyst to activate the gun powder known as a propellant housed within the casing of the ammunition. Finally, a bullet is discharged from the barrel of the gun when the burning propellant creates sufficient gas pressure and the requisite energy to thrust the bullet from its casing and down the barrel of the gun. The entire process takes a fraction of a second and the bullet is forced out the barrel of gun at a speed of 1700 miles per hour.

Within thee-primer 10, the process to create a flash to begin the propellant (shock sensitive chemical) activation process is now replaced with an electrical ignition that uses energy harvesting system and switch rather than a mechanical (shock sensitive chemical) process. A thermal wire 22 serves to replace the ignition phase of the energetic train. The thermal wire 22 quickly heats up and burns when powered by an electrical signal. The heating process in turn is used as the catalyst for advancing the energetic train.

It is well known that firearm systems have been built to include an external power supply which is operatively coupled to the firing pin 28. The electrical contact on the firing pin is capable of activating a primer build to use this battery power to initiate the energetic train. The drawback to this approach is that the firearm needs to be modified to hold a battery pack or the ammunition itself must include its own battery.

The ammunition of the instant invention does not require a battery, which are known to have a finite shelf life. The reliability required to fire a round of ammunition must be as close to 100% as possible since it is used to defend and or protect life and the power source for the ammunition should be virtually guaranteed. Accordingly, what is needed is a way to power the electronic firing system inside the ammunition, but without a physical battery. Furthermore, the ammunition needs to be deactivated or naturalized when in an area equipped with a SafeZone transmitter system. The SafeZone transmitter system is a virtual electronic fence defined by a plurality of transmitter for remotely transmitting the control signal to the microcontroller to selectively neutralize the ammunition wherein the control signal includes a neutralization code for dictating whether the thermal wire receives electrical energy.

The invention 10 presented below teaches a new design and method to provide battery power for the thermal wire 22 and microprocess from within the ammunition itself as well as a means to disable or activate the firing of the ammunition within a SafeZone. There are two unique means for powering the system described below. The overall approach is known as energy harvesting. The invention 10 teaches the utilization of the mechanical force of the firing pin 28 striking a piezoelectric crystal 14 mounted within the primer cup producing a deformation stressing the crystalline structure thus producing electrical energy. This brief impulse of electrical energy is captured and stored within the capacitor 18 mounted within the primer cup 30 and or the ammunition casing. Yet in another embodiment, the energy can be harvested from exciting the piezo crystal structure 14 with where acoustic waves or vibrations and converted into electrical energy. It is well known that piezo crystals can be tuned by their shape, mass and material construction. An acoustic wave or vibration which propagates in proximity of the piezo crystal 14 will enable excitation of the piezo crystal 14 can be harvested while the transmission is present. The harvested power can be stored within the capacitor 18 mounted in the casing. In addition, the firing pin 28 also activates a safety switch 26 permitting the energy created by piezo crystal 14 to activate a thermal wire 22 mounted in close proximity to the nanoenergetic material 24 mounted in the casing. Additionally, the electronic control switch is controlled by a RF, acoustic or other forms of a communications link.

The invention considers the following:

When a round of ammunition equipped with an energy harvesting electronic primer that can be remotely neutralized or activated enters an area that contains signals form a transmitter whose functions are two-fold, to transmit an encoded signal capable of providing the RF or acoustic waveform and control signal information where by the ammunition could detect these signals though the antenna for the RF and or a piezo resonator for the acoustic interface incorporated into the ammunition. These signals are then converted into power using either the piezo crystal 14 mounted in the ammunition if acoustic or from the antenna and become rectified through a diode 16 into a de voltage and charging of a capacitor 18. The output of the capacitor 18 drives the necessary voltage to power on a RF receiver and microprocessor 20. Should the remote transmitted RF or acoustic signal contain no control information, the microcontroller 20 normal state is true, such that the signal feed into the microcontroller 20 would be seen as a "1" on its output and would allow thee-primer 10 to become active. The control signal, if true, would allow the harvested energy from the firing pin 28 interacting with the stressed piezo 14 mounted in the primer cup 30 to pass to the thermal wire 22 thereby activating the nonenergetic materials 24 which in turn would allow the discharged of the firearm. If the transmitted signal were a "0" or false, the microcontroller 20 would not allow the control signal to pass through it and would not allow the firearm to be discharged regardless if the trigger is pulled as the thermal wire would not be allowed to activate. The final step in the process is the mechanical activation of a control switch that is engaged once the firing pin 28 strikes the primer cup with sufficient force. This safety switch 26 serves to ensure that no accidental discharging of the ammunition could happen based on a stray signal finding its way into the ammunition circuitry. As an example, when the ammunition enters into a SafeZone in a school or other location that has been equipped with an RF or acoustic transmitter or transceiver, and the control signal is set for a "0" or "false" the ammunition becomes instantly neutralized, unable to be fired from a user.

In another embodiment, a process to overwrite the microcontroller 20 instruction could be used by the police agencies or other law enforcement officials so their firearms can be fired in SafeZone locations. In this embodiment, the police would have unique e-primer ammunition with a special code that allows their firearm to be fired in a SafeZone location while other "e-primer" ammunition being used by other that the police would be neutralized. This special code would override the neutralization signal enabling the activation of the nanoenergetic material thereby allowing the ammunition to be discharged.

Another inventive step is disclosed whereas, the e-primer ammunition must operate in the same way that conventional primer ammunition operates. This requires a solution to harvest power when no RF signal or acoustic wave signal is present. The invention 10 considers using striking force of the firing pin 28, making contact with the piezo element 14 mounted in the primer cup to convert this energy from mechanical to electrical power. Under such a scenario, the e-primer equipped ammunition could be fired from the firearm, where the power is harvested from the piezo element, stored in a capacitor, distributed to the microcontroller whose normal state is a "1" and where by the control signal to activate the thermal wire is established and the activation of the nanoenergetic material is enabled, burns the next stage of the powder and the bullet is discharged. For additional safety reasons, the power can be first sent to the switch inside the primer cup and is activated when the firing pin strikes the primer cup and establishes contact.

If the e-primer is authorized by a RF signal or acoustic wave the ammunition will fire. If it is not authorized, the microcomputer will neutralize the firing, and the primer would not be ignited.

There are other ways of deactivating the ammunition, as an example. If you are in a public space, not in a SafeZone area, and have authorization to neutralize the ammunition from firing, a transmitter array will transmit RF or acoustic code to change the status of the microprocessor and prevent the firing of the firearm instantaneously.

A individual carries a gun into a SafeZone®

The trigger is pulled.

Firing pin fires into electronic primer.

What makes this primer electronic?

- There is a piezo membrane and capacitor, diode and a radio receiver, microcomputer and thermal wire as part of its construction.
- The capacitor is storing the harvested energy while in in a SafeZone® room with the RF or acoustic transmitter propagating energy.
- The piezo harvests energy for the activation of the thermal wire by the firing pin striking the primer cap which is encompassing the piezo.
- The stored capacitor then provides the power for the receiver and microcomputer operational needs.

When the microcomputer turns on, it will communicate decode the transmitted signal or otherwise allow for its preprogrammed command to be advanced.

The microcomputer decodes the transmitted signal within the SafeZone®

If it is authorized, the transmitter will send 1's to be decoded by microcomputer, letting it know it can proceed to fire.

If it is not authorized, the transmitter will send 0's to the microcomputer, letting it know that no bullet will be fired in this SafeZone®

The primer essentially now serves as a electronic control switch as well

So, if it is authorized, the two wires (in diagram A) will connect, thus turning on the electronic control switch.

When this switch makes contact, it allows the initial firing of nanoenergetic of the primer and the bullet is fired.

A safety switch can be incorporated which is activated upon the firing pin making contact with the e-primer.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An energy harvesting electronic primer (e-primer) system that enhances public safety by selectively controlling the discharge of ammunition, said system comprising:

a piezo element adapted for receiving an external stimulus and converting said external stimulus harvested into an electrical energy;

an external stimulus generating means, in communication with said piezo element, for imparting a mechanical force on said piezo element;

a safety switch in communication with said piezo element that is closed by a force generated by said external stimulus generating means;

a diode in electrical communication with said piezo element for rectifying said electrical energy into DC voltage;

a capacitor in electrical communication with said diode for storing the electrical energy;

a microcontroller in electrical communication with said capacitor for receiving the electrical energy used to power said microcontroller, said microcontroller providing a control switch to selectively allow or prevent flow of said electrical energy;

an antenna in electrical communication with said microcontroller for receiving a remotely transmitted control signal and facilitating its transmission to said microcontroller, said remotely transmitted control signal having a control code that indicates whether said microcontroller allows or prevents flow of said electrical energy;

a thermal wire in electrical communication with said microcontroller for selectively receiving the electrical energy from said capacitor as dictated by said microcontroller, said remotely transmitted control signal indicating whether said thermal wire receives said electrical energy to remotely activate or deactivate said ammunition; and a nanoenergetic material in communication with said thermal wire for igniting said nanoenergetic material, said thermal wire burning said nanoenergetic material when receiving said electrical energy to activate the ammunition.

2. A system as recited in claim 1, wherein said external stimulus generating means comprises:

a firing pin in selective communication with said piezo element for selectively exerting a mechanical force on said piezo element.

3. A system as recited in claim 2, wherein the safety switch in communication with said piezo element is closed when contacted by said firing pin.

4. A system as recited in claim 1, wherein said system further comprises:

an RF transmitter for generating and transmitting said remotely transmitted control signal to said antenna for transmission to said microcontroller, said remotely transmitted control signal including said control code for indicating to said microcontroller whether to allow flow of said electrical energy to said thermal wire.

5. A system as recited in claim 4, wherein said system further comprises:

an override code that enables said thermal wire to receive said electrical energy when said control code is programmed to withhold said electrical energy from said thermal wire.

6. A system as recited in claim 1, wherein said system further comprises:

an acoustic wave transmitter for generating and transmitting said remotely transmitted control signal as an acoustic wave to said antenna for transmission to said microcontroller, said acoustic wave including a control code for indicating whether to deactivate or activate said thermal wire.

7. A system as recited in claim 6, wherein said microcontroller further comprises:

an active state code that enables said thermal wire to always receive electrical energy.

8. A system as recited in claim 1, wherein said system further comprises:

a primer cup housing said piezo element, said capacitor, said microcontroller and said thermal wire.

9. A system as recited in claim 8, wherein said primer cup comprises:

a flash hole in communication with said nanoenergetic material for releasing hot burning particles of said nanoenergetic material when heated by said thermal wire to provide a catalyst to activate gun powder in communication with said flash hole.

10. A system as recited in claim 8, wherein said system further comprises: a bullet in mechanical communication with said primer cup.

11. A system as recited in claim 1, further comprising:

a virtual electronic fence defined by a transmitter for transmitting said control signal to said microcontroller to selectively control said ammunition, said control signal including a control code for dictating whether said thermal wire receives said electrical energy.

12. A system as recited in claim 1, wherein said microcontroller has a normal state wherein said control signal is seen as a "1" so said electrical energy is allowed to flow to said thermal wire.

13. A system as recited in claim 12, wherein said control signal includes a "O" setting that prevents said electrical energy from flowing to said thermal wire.

14. An energy harvesting electronic primer (e-primer) system that enhances public safety by selectively controlling the discharge of ammunition, said system comprising:

a piezo element adapted for receiving an external stimulus and converting said external stimulus harvested into an electrical energy;

an external stimulus generating means, in communication with said piezo element, for imparting a mechanical force on said piezo element;

a safety switch in communication with said piezo element that is closed by a force generated by external stimulus generating means;

a diode in electrical communication with said piezo element for rectifying said electrical energy into DC voltage;

a capacitor in electrical communication with said diode for storing the electrical energy;

a microcontroller in electrical communication with said capacitor for receiving the electrical energy used to power said microcontroller, said microcontroller providing a control switch to selectively allow or prevent flow of said electrical energy;

an antenna in electrical communication with said microcontroller for receiving a remotely transmitted control signal and facilitating its transmission to said microcontroller, said remotely transmitted control signal having a neutralization code that indicates whether said microcontroller allows or prevents flow of said electrical energy;

a thermal wire in electrical communication with said microcontroller for selectively receiving the electrical energy from said capacitor as dictated by said microcontroller, said remotely transmitted control signal indicating whether said thermal wire receives said electrical energy to remotely activate or deactivate said ammunition;

a nanoenergetic material in communication with said thermal wire for igniting said nanoenergetic material, said thermal wire burning said nanoenergetic material when receiving said electrical energy to activate the ammunition; and at least one transmitter for transmitting said remotely transmitted control signal to said microcontroller to selectively neutralize or activate said ammunition, said control signal including a control code for dictating whether said thermal wire receives said electrical energy.

15. A system as recited in claim 14, further comprising:

a virtual electronic safety fence defined by the at least one transmitter for transmitting said remotely transmitted control signal to said microcontroller to selectively neutralize said ammunition, said control signal containing a control code for dictating whether said thermal wire receives said electrical energy.

16. A system as recited in claim 14, wherein said system further comprises:

a primer cup housing said piezo element, said capacitor, said microcontroller and said thermal wire; said primer cup having a flash hole in communication with said nanoenergetic material for releasing hot burning particles of said nanoenergetic material when heated by said thermal wire to provide a catalyst to activate gun powder in communication with said flash hole.

17. A system as recited in claim 14, wherein said system further comprises:

an active state code that enables said thermal wire to always receive said electrical energy.

* * * * *